United States Patent [19]

Pouderoux et al.

[11] 4,418,748

[45] Dec. 6, 1983

[54] HEAT EXCHANGER WHOSE HOT END HAS A DEVICE FOR PROTECTING THE TUBE PLATE

[75] Inventors: Pierre Pouderoux, Meudon la Foret; Guy Salon, Parly II; Thong Nguyen-Thanh, Cernay-la-Ville, all of France

[73] Assignees: Commissariat a l'Energie Atomique, Paris; Stein Industri, Velizy Villacoublay, both of France

[21] Appl. No.: 343,246

[22] Filed: Jan. 27, 1982

[30] Foreign Application Priority Data

Feb. 2, 1981 [FR] France ..... 81 01954

[51] Int. Cl.[3] ..... F28D 7/00; F28F 9/22; F28F 13/06; F22B 1/06

[52] U.S. Cl. ..... 165/134 R; 122/32; 165/158; 165/160; 165/161

[58] Field of Search ..... 165/134 R, 158, 160, 165/161; 122/512, 32, 34

[56] References Cited

U.S. PATENT DOCUMENTS

| | | | |
|---|---|---|---|
| 3,245,464 | 4/1966 | Ammon et al. | 165/158 X |
| 3,545,536 | 12/1970 | Peters et al. | 165/134 R |
| 3,630,274 | 12/1971 | Lievense | 165/134 R |
| 3,768,554 | 10/1973 | Stahl | 165/134 R |
| 3,811,498 | 5/1974 | Ferraro et al. | 165/161 |

FOREIGN PATENT DOCUMENTS

| | | | |
|---|---|---|---|
| 2713668 | 11/1977 | Fed. Rep. of Germany . | |
| 1536825 | 7/1968 | France . | |
| 2010568 | 6/1969 | France . | |
| 55-23850 | 2/1980 | Japan | 165/134 R |
| 2082750 | 3/1982 | United Kingdom | 165/134 R |

*Primary Examiner*—Sheldon J. Richter
*Attorney, Agent, or Firm*—Oblon, Fisher, Spivak, McClelland & Maier

[57] ABSTRACT

A heat exchanger comprising an outer casing closed at its hot and cool ends by two tube plates, a cluster of tubes which is connected to the tube plates to discharge into inlet and outlet collectors of a fluid flowing inside the tubes, and inlet and outlet tubings of a liquid flowing in the casing and around the tubes, wherein the exchanger comprises at its hot end a device for protecting the tube plate, such device comprising two plates united by a casing to define a first zone filled with such liquid in the static state forming a thermal screen, such plates being substantially parallel with the tube plate and a first one of such plates being disposed adjacent the tube plate, the protective device also comprising passages extending through such zone from one plate to another, and means for setting up a negative pressure between such first plate and the tube plates, to ensure that such liquid flows towards the tube plate inside such passages.

Special application to heat exchangers for steam generators with liquid sodium primary fluid.

5 Claims, 5 Drawing Figures

HEAT EXCHANGER WHOSE HOT END HAS A DEVICE FOR PROTECTING THE TUBE PLATE

The invention relates to a heat exchanger whose hot end has a device for protecting the tube plate. More precisely the invention relates to a heat exchanger comprising an outer casing closed at its hot and cool ends by two tube plates, a cluster of tubes which is connected to the tube plates to discharge into inlet and outlet collectors of a fluid flowing inside the tubes, and inlet and outlet tubings of a liquid flowing in the casing and around the tubes.

Exchangers of the kind specified, such as those forming part of an installation for producing electric power from a fast neutron nuclear reactor, in which the alkaline metal is generally sodium, comprise a hot end at a temperature appreciably higher than 500° C., the sodium being at a temperature of about 525° C. and the water leaving the tube plate towards 495° C. at a pressure of the order of 200 bar. The tube plate must therefore be very thick and have considerable thermal inertia, causing heavy thermal stresses during the start-up, stoppage or changes in the operation of the installation. It would be advantageous to make a plate of the kind specified of a ferritic steel with 2.25% chromium and 1% molybdenum, which is less expensive than austenitic steels, but a ferritic steel of this kind undergoes a decarburation in contact with the hot sodium as soon as the temperature of the latter appreciably exceeds 500° C. On the other hand, the temperature of the hot end of the exchanger cannot be reduced without appreciably reducing the output of the installation.

PROBLEM

It is an object of the invention to obviate these disadvantages and to provide a device for protecting the tube plate at the hot end of the exchanger; this reduces the temperature of the liquid alkaline metal directly contacting such hot end, without however reducing the temperature of the superheated steam arriving at the tube plate, so that the thermal stresses therein when the operating conditions of the installation are changed is reduced, although a flow of alkaline metal is ensured around the nipples where the tubes join the tube plate. Another object of the invention is to enable the tube plate to be made from a ferritic steel with a relatively low chromium content and to ensure that the flowing alkaline metal sweeps the welds of the tubes at the joining nipples.

BRIEF SUMMARY OF THE INVENTION

To this end the invention provides a heat exchanger wherein the exchanger comprises at its hot end a device for protecting the tube plate, such device comprising two plates united by a casing to define a first zone filled with such liquid in the static state forming a thermal screen, such plates being substantially parallel with the tube plate and a first one of such plates being disposed adjacent the tube plate, the protective device also comprising passages extending through such zone from one plate to another, and means for setting up a negative pressure between such first plate and the tube plates, to ensure that such liquid flows towards the tube plate inside such passages.

The heat exchanger according to the invention also has at least one of the following features:

the passages are annular passages defined between the tubes of the cluster and sheathes inside which the tubes extend through the plates;

the space defined between the first plate and the tube plate communicates with an annular zone enclosing the first zone, and the means for setting up a negative pressure comprise tubes via which such annular zone communicates with a second annular zone connected by apertures to a zone enclosing the tubes of the cluster downstream of the tube plate;

it also comprises at least one intermediate plate disposed between the parallel plates and parallel therewith;

the second plate is connected to the external casing by a cylindrical casing formed with filling and emptying holes which enable the liquid to enter during filling and to be discharged during the emptying of the exchanger.

DESCRIPTION OF DRAWINGS

A non-limitative, exemplary embodiment of the invention will now be described with reference to the accompanying drawings, wherein.

DETAILED DESCRIPTION OF THE PREFERRED EMBODIMENTS

Figure 1:
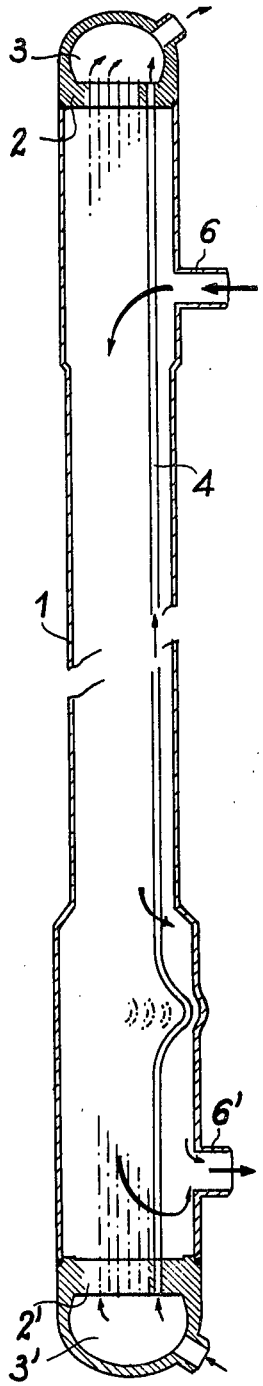
FIG. 1 is a diagrammatic view in longitudinal section of a vertical heat exchanger between the water to be vaporized and superheated and hot liquid sodium, such exchanger comprising according to the invention a device for protecting the hot upper tube plate.

FIG. 1 shows how the exchanger comprises a vertical external casing 1 which is closed at its top and bottom ends by tube plates 2, 2' to which tubes, as 4, of a cluster of straight tubes disposed inside the casing 1 are connected. The tubes discharge at the bottom part of the exchanger into an inlet collector 3' of the secondary circuit water, and at its top part into an outlet collector 3 of the vaporized water respectively. The water to be vaporized therefore flows upwardly inside the tubes 4 between the collectors 3' and 3.

The liquid metal (generally sodium) flowing in the primary circuit of the exchanger moves in counter-current in relation to the water of the primary circuit—i.e., downwardly inside the casing 1 and around the tubes 4, between an inlet tubing 6 and an outlet tubing 6'.

The hottest zone of the exchanger is therefore its upper part into which the liquid metal penetrates; this part will now be described in greater detail with reference to FIG. 2.

Figure 2:
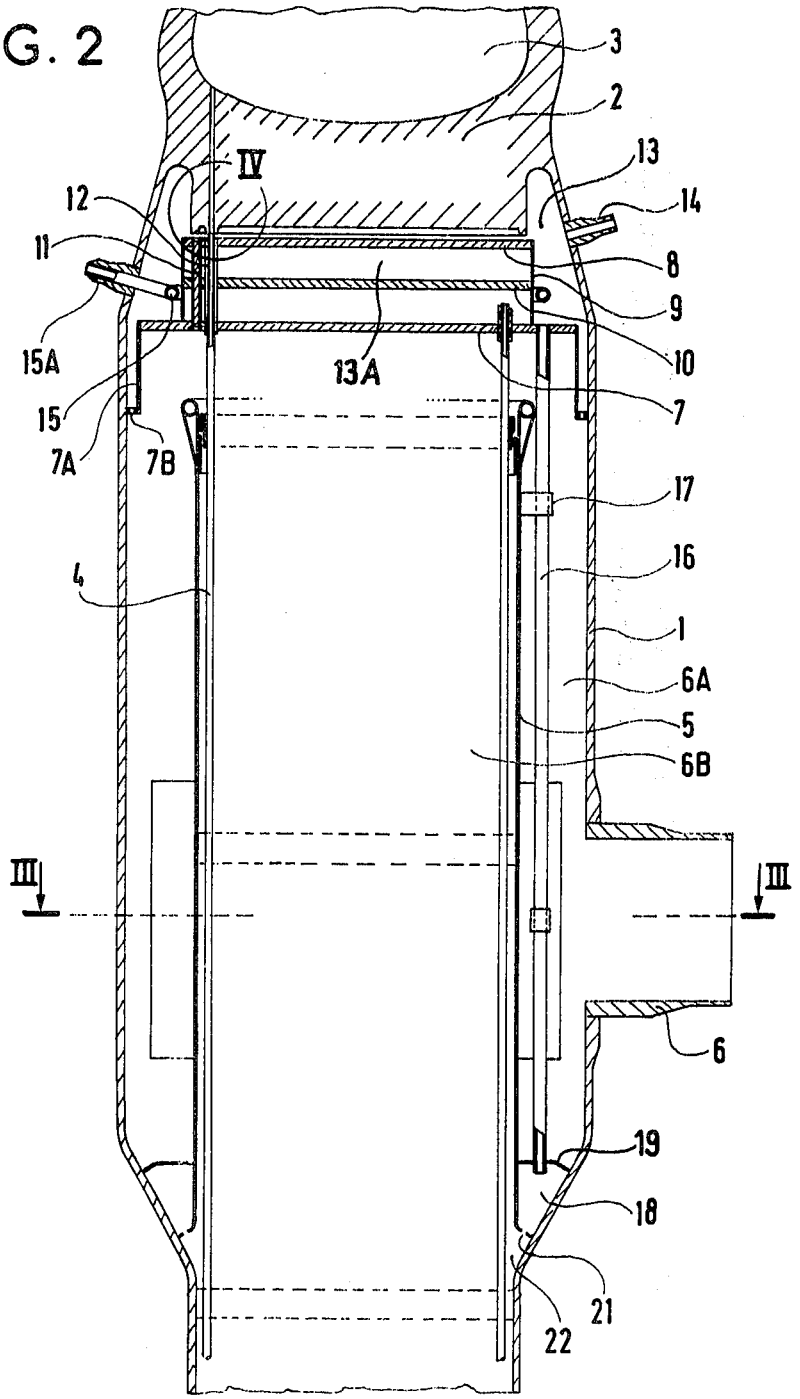
FIG. 2 is a view in longitudinal section, to an enlarged scale, taken along the line II—II in FIG. 3, showing the top part of the exchanger illustrated in FIG. 1.

We see at once from FIG. 2 that the upper part of the tube cluster 4 is enclosed by a thin internal casing 5 where the inlet tubing 6 for the hot liquid sodium is disposed. The casing 5 is connected to the external casing 1 below the tube 6, its top end terminating adjacent the protective device according to the invention, so that the hot liquid sodium moves up through an annular zone 6A defined between the casings 1 and 5, before descending again in the zone 6B inside the casing 5, around the tubes 4 of the cluster, in counter-current with the water flowing in such tubes.

Figure 5:
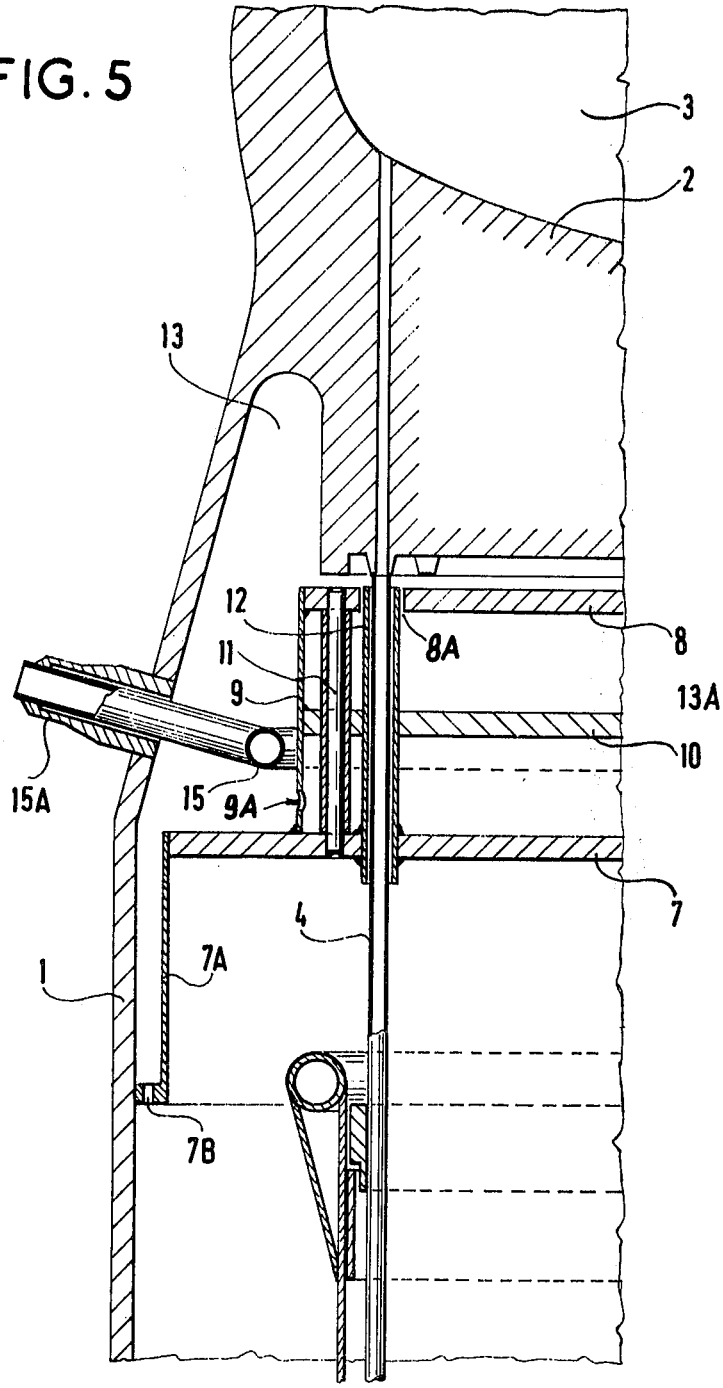
FIG. 5 is a view in longitudinal section, to an enlarged scale, of the left-hand part of the device for protecting the tube plate.

According to the invention, a device for protecting the tube plate 2, a portion of which is shown to an enlarged scale in FIG. 5, comprises a first flat plate 7 parallel with the tube plate 2 or, in other words, perpendicular to the axis of the exchanger, and disposed above the top end of the internal casing 5. The plate 7 is attached by its periphery to the external casing 1 via a cylindrical casing 7A having a bottom flange welded to the inside wall of the external casing.

The protective device according to the invention also comprises a second flat plate 8 which is parallel with the first plate 7 and disposed thereabove adjacent the bottom face of the tube plate 2 through which the tubes 4 extend.

Although it is much smaller than the plate 7, the plate 8 extends over the whole surface of the tube plate 2. The plates 7 and 8 are connected at the periphery of the plate 8 by a thin cylindrical casing 9 welded to such plates. The zone 13A thus defined between the plates 7 and 8 and the casing 9 is filled with practically static sodium acting as a thermal screen between the hot sodium introduced via the tubing 6 and the tube plate 2.

To limit further the convection currents of the liquid sodium present in the zone 13A, an intermediate flat plate 10 of the same size as the plate 8 and welded to the casing 9 is disposed preferably half-way between the plates 7 and 8. This feature improves the role of thermal screen played by the sodium contained in the zone 13A.

Having regard to the relative thinness of the casing 9, the plates are fully strengthened by means of struts 11 welded thereto.

Figure 4:
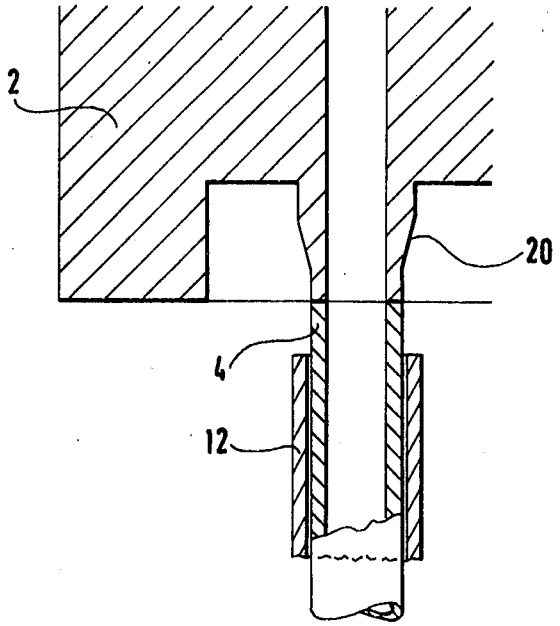
FIG. 4 shows to an enlarged scale the detail IV in FIG. 2, relating to the join between a tube of the exchanger and its connecting nipple with the tube plate.

The tubes 4 of the tube cluster extend through the plates 7, 10 and 8 inside sheathes 12 which are welded to the plate 7 and extend through the plates 10 and 8. The sheathes 12 co-operate with the tubes 4 to bound annular passages via which the hot liquid sodium can flow upwards from the zone 6B of the exchanger disposed below the plate 7, as far as the tube plate 2 and the annular zone 13 bounded around the zone 13A and separated from the rest of the exchanger by the casing 7A. More precisely, and as shown in FIG. 4, the annular passages defined between the sheathes 12 and the tubes 4 discharge above the zone 13A, forming a thermal screen adjacent the nipples 20 of the tube plate to which the tubes are welded. This structure is continued over the whole extent of the tube plate 2, so that the ascending flow of the hot liquid sodium has the effect of ensuring an efficient sweeping of the weldings of the tubes at the nipples 20. Moreover, the liquid sodium is cooled as it passes through the sheathes 12 by heat exchange with the water flowing in the tubes, so that the liquid sodium arrives at the welds at a temperature substantially lower than the one which it had when it entered the exchanger.

Figure 3:
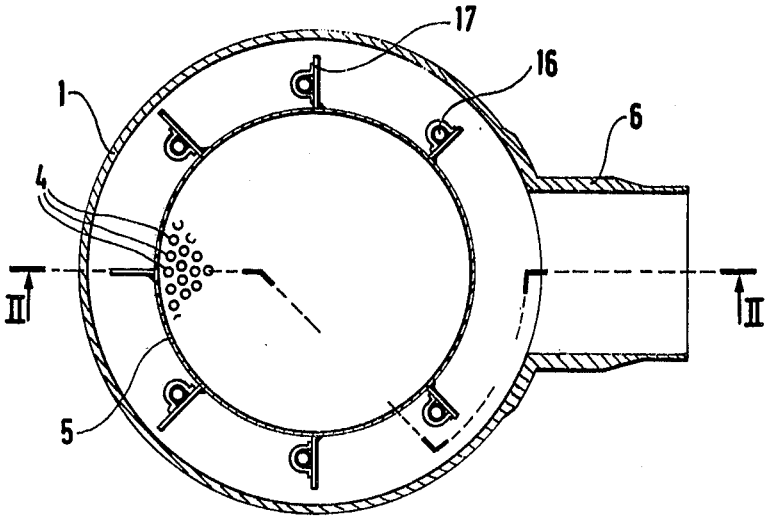
FIG. 3 is a view in cross-section, taken along the line III—III in FIG. 2.

The ascending flow of the liquid sodium in the passages defined between the tubes 4 and the sheathes 12 is obtained by setting up a negative pressure in the zone 13 in relation to the pressure in the zone of sodium flow below the plate 7. For this purpose zone 13 is connected to an annular zone 18 via a series of vertical tubes 16 extending through the zone 6A between the casings 1 and 5. As shown in FIG. 3, the tubes 16 are welded to shoes 17 attached to the internal casing 5. The zone 18 is situated below the zone 6A and separated therefrom by a partition 19, and it communicates with a portion 22 of the zone 6B inside the casing 5 via apertures 21 formed therein adjacent the place where its bottom end joins the external casing 1. The portion 22 of the zone 6B lies downstream of the portion situated immediately below the plate 7, so that at that place the liquid sodium is at a lower pressure, because of the load loss.

The filling and emptying of the zones 13 and 13A are performed in the first place by means of holes 7B formed in the flange of the casing 7A welded to the external casing 1 and enabling the liquid sodium to enter during filling and to be discharged during emptying, while in practice preventing any appreciable flow during the operation of the exchanger. Moreover, the bottom of the casing 9 has apertures 9A, and there is a clearance 8A between the sheathes 12 and the plate 8. These latter arrangements allow the filling and emptying of the sodium of zone 13A forming a thermal screen.

In customary manner, the annular zone 13 enclosing the end of the tube plate is connected via a tubing 14 to an argon reserve. A perforated annulus 15 for sampling sodium for analysis is connected via a tubing 15A to an analytical apparatus (not shown) adapted to detect any leakages from the welds of the tubes 4 to the nipples 20.

By way of example, when the hot liquid sodium enters the exchanger at a temperature of about 525° C., the protective device disclosed hereinbefore brings the temperature of the liquid sodium in direct contact with the tube plate down to about 500° C. This allows the use of tube plates made of ferritic steel with 2.25% chromium and 1% molybdenum instead of austenitic steel, while preventing the decarburation of the ferritic steel by the hot sodium, which would be considerable at 525° C. Moreover, the protection device using thin parallel plates protects the tube plate against thermal shocks resulting from transistory changes in operating conditions, and enables it to be given a higher permissible operating rate than if it were directly in contact with the hot sodium at 525° C., inter alia as regards the nipples 20.

Moreover, the sodium flow ensured by the negative pressure set up in the annular zone enclosing the tube plate enables the welds of the tubes of the cluster to be efficiently swept at the nipples of the tube plate, thus enabling any leakage from such welds to be detected very quickly.

Although the protective device disclosed hereinbefore with reference to the drawings seems to be the preferable embodiment of the invention, various modifications can of course be made thereto without exceeding the scope of the invention; certain of its members might be replaced by others performing a similar technical function.

Moreover, the invention has been disclosed with reference to a heat exchanger whose heating fluid is liquid sodium and the heated fluid of water, but of course the invention relates in particular to steam generators heated by liquid metals and, in a more general way, to heat exchangers from which tubes extend via tube plates, casings or collectors.

What we claim is:

1. A heat exchanger comprising an outer casing closed at its hot and cool ends by two tube plates, a cluster of tubes which is connected to the tube plates to discharge into inlet and outlet collectors of a fluid flowing inside the tubes, and inlet and outlet tubings of a liquid flowing in the casing and around the tubes, wherein the exchanger comprises at its hot end a device for protecting the tube plate, such device comprising two plates united by a casing to define a first zone filled with such liquid in the static state forming a thermal screen, such plates being substantially parallel with the tube plate and a first one of such plates being disposed adjacent the tube plate, the protective device also comprising passages extending through such zone from one plate to another, and means for setting up a negative pressure between such first plate and the tube plates, to ensure that such liquid flows towards the tube plate inside such passages.

2. An exchanger according to claim 1, wherein the passages are annular passages defined between the tubes of the cluster and sheathes inside which the tubes extend through the plates.

3. An exchanger according to claims 1 or 2, wherein the space defined between the first plate and the tube plate communicates with an annular zone enclosing the first zone, and the means for setting up a negative pressure comprise tubes via which such annular zone communicates with a second annular zone connected by apertures to a zone enclosing the tubes of the cluster downstream of the tube plate.

4. An exchanger according to claim 1, wherein it also comprises at least one intermediate plate disposed between the parallel plates and parallel therewith.

5. A device according to claim 1, wherein the second plate is connected to the external casing by a cylindrical casing formed with filling and emptying holes which enable the liquid to enter during filling and to be discharged during the emptying of the exchanger.

* * * * *